United States Patent [19]

Ackerman

[11] Patent Number: 4,915,380

[45] Date of Patent: Apr. 10, 1990

[54] BASKETBALL REBOUNDER

[76] Inventor: Bob J. Ackerman, Rural Route #1, Cedar Street, Canton, Ill. 61520

[21] Appl. No.: 280,875

[22] Filed: Dec. 7, 1988

[51] Int. Cl.[4] ..... A63B 69/00

[52] U.S. Cl. ..... 273/15 A

[58] Field of Search ..... 273/1.5 R, 1.5 A, 395, 273/396

[56] References Cited

U.S. PATENT DOCUMENTS

| | | | |
|---|---|---|---|
| 1,765,269 | 4/1929 | Hatley | 273/1.5 A |
| 2,838,308 | 6/1958 | Polite | 273/396 XR |
| 2,889,149 | 6/1959 | Williams | 273/396 |
| 3,233,896 | 5/1962 | King | 273/1.5 A |
| 3,544,109 | 12/1970 | Woods | 273/396 XR |
| 3,561,762 | 2/1971 | Russell | 273/396 |
| 3,776,550 | 12/1973 | McNabb | 273/1.5 A |
| 3,814,421 | 6/1974 | Spier | 273/1.5 A |
| 3,917,263 | 11/1975 | Wiley | 273/1.5 A |
| 4,421,318 | 12/1983 | Sverdlik et al. | 273/395 |
| 4,579,339 | 4/1986 | Grimm | 273/1.5 A |
| 4,579,340 | 4/1986 | Jenkins | 283/1.5 A |
| 4,678,189 | 7/1987 | Koss | 273/1.5 A |

*Primary Examiner*—Paul E. Shapiro

*Attorney, Agent, or Firm*—Sixbey, Friedman, Leedom & Ferguson

[57] ABSTRACT

An apparatus 10 for returning a basketball to a shooter includes an elongate net 18 with a first end portion 20 connected to a basketball net 12 of a basketball backboard 14 and rim 16 combination. The elongate net 18 receives a basketball which has been successfully shot and directs that ball generally toward a frame 24 positioned immediately in front of the shooter. The elongated net second end portion 22 is connected to the frame 24 and, in particular, adjacent a deflection board 28. The deflection board 28 is connected to the frame 24 and positionable at a plurality of angles relative to the playing surface 26. Accordingly, a basketball traveling along the interior of the elongate net 18 exits the second end portion 22 and rebounds off of the deflection board 28 in a direction generally upward and toward the shooter. In this manner, a successfully completed shot is quickly and efficiently returned to the shooter. The frame 24 is movable to a plurality of desired positions on the playing surface 26 to facilitate practice at a variety of desired positions.

15 Claims, 1 Drawing Sheet

BASKETBALL REBOUNDER

BACKGROUND OF THE INVENTION

1. Field of the Invention

This invention relates generally to a practice aide for improving the shooting skills of a basketball player, and more particularly, to an apparatus which attaches to the net rim of a basket ball backboard and returns the basketball to a desired position on the court.

2. Description of the Related Art

Today more then ever before, organized sports have opened the door to educational and financial opportunity. For example, those individuals who excel in a particular sport can expect to attend some of the most highly regarded educational institutions in the world. To the skilled sportsman impecunity is no longer a barrier to higher education. In fact, nearly all major institutions award full scholarships to highly skilled athletes. Basketball, in particular, has resulted in numerous scholarships. Moreover, the financial awards available to the select few who reach professional status are staggering.

Basketball is a sport which requires a number of different skills. For example, a particular athlete may excel in one or more of the following skills: ball control; defense; passing; or shooting. While all these skills are highly desirable and sought after, good shooting ability is prized above the others. Indeed, the object of the game of basketball is to score points. This ultimately can only be achieved by shooting the basketball.

Many people believe that a good shooter is a result of natural ability. While star athletes admittedly possess considerable natural talent, shooting it is a learned skill. As a physical skill, it is necessary, and is in fact required that the shooter practice extensively. Accordingly, devices which facilitate and encourage practice are highly desirable. Such devices have, however, suffered from numerous problems of being difficult to install, complex, expensive, ineffective, cumbersome, etc. Rather, it is desirable that the practice aide be simple in construction, easy to install, and quickly and efficiently return the basketball to the shooter at a comfortable position.

The instant apparatus is directed to overcoming one or more problems that are set forth above.

SUMMARY OF THE INVENTION

The primary object of the present invention is to provide an apparatus that returns a basketball to a shooter at a preselected location and desired vertical height.

Another object of the present invention is to provide a basketball return apparatus that is readily moveable and positionable at a plurality of locations on a playing surface.

Yet another object of the invention is to provide a basketball return apparatus that is adjustable to deflect the returning basketball to a preselected vertical height.

Still another object of the present invention is to provide a basketball return apparatus which has a deflection board that is adjustable to a plurality of preselected angles for deflecting the returning basketball to a preselected vertical height.

To attain these and other objectives, an apparatus is provided for use in combination with a basketball rim and net for returning a basketball to a preselected location on a playing court. An elongate net has first and second end portions, an interior surface, an exterior surface, and openings at the first and second end portions. The first end portion is connected to one of the basketball rim and net whereby a ball passing through the rim enters the first end portion opening of the elongate net and moves along the interior of the elongate net in a direction generally toward the elongate net second end portion. A frame has a support surface and is moveably positionable on the playing surface. A deflection board has a ball striking surface and is connected to the frame at a preselected angle relative to the playing floor. The elongate net second end portion is connected to one of the frame and deflection board whereby a basketball traveling along the interior of the elongate net in a direction toward the second end portion exits the elongate net second end portion opening and is deflected off of the ball striking surface of the deflection board.

BRIEF DESCRIPTION OF THE DRAWINGS

Other objects and advantages of the invention will become apparent upon reading the following detailed description and upon reference to the drawings in which.

Figure 1:
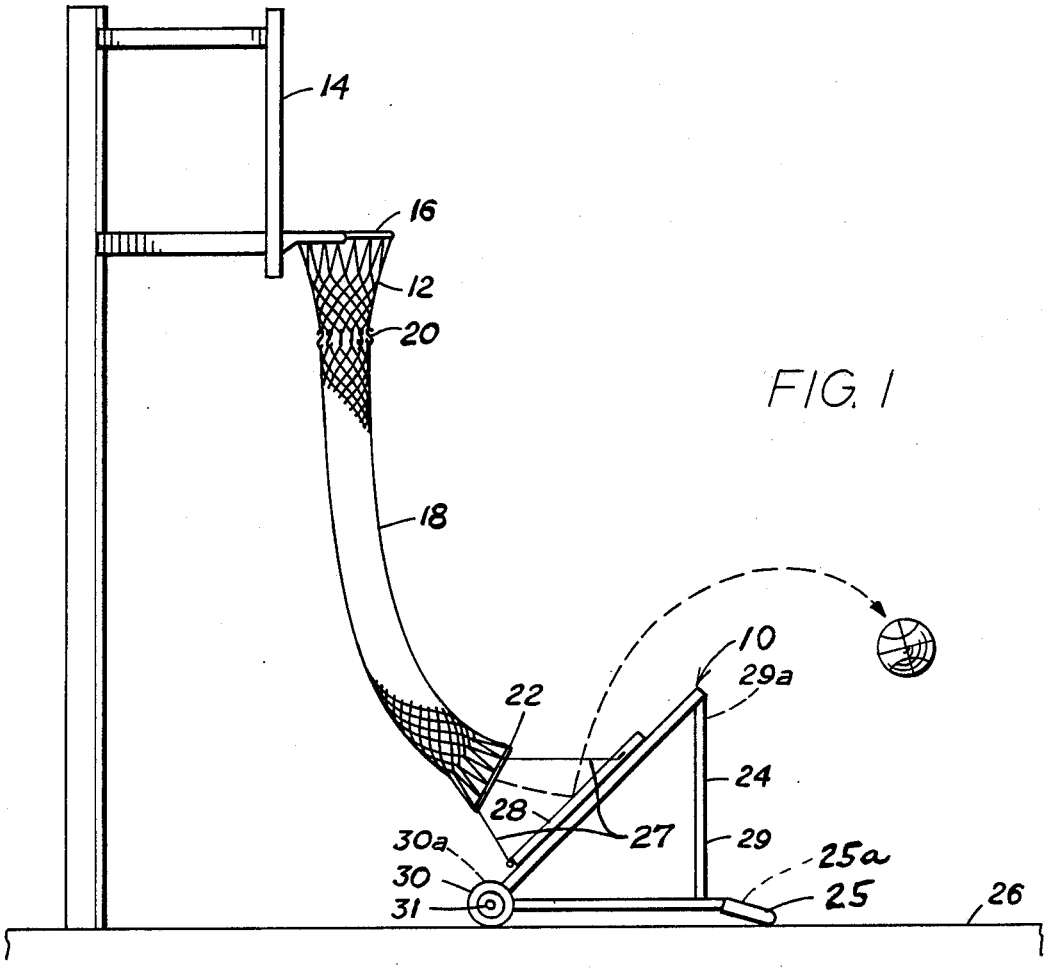
FIG. 1 is a side view of the apparatus connected to a backboard rim net combination.

While the invention is susceptible to various modifications and alternative forms, the specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope as defined by the appended claims.

DESCRIPTION OF THE PREFERRED EMBODIMENT

FIG. 1 illustrates an apparatus 10 connected to a net 12 of a basketball backboard 14 and rim 16 combination. The apparatus 10 includes an elongate net 18, the elongate net 18 includes a first end portion 20 and a second end portion 22 and is generally tubular in configuration with an interior and exterior surface and openings adjacent the first and second end portions 20, 22. The first end portion 20 is connected to the basketball net 12 at its lower end portion by, for example, a series of four S-type hooks. The conventional lower opening of the basketball net 12 is generally coaxial with the elongate net first end portion 20 and its opening. Therefore, a basketball passing through the rim 16 and net 12 enters the elongate net 18 at the first end portion opening 20 and travels along the interior of the elongate net 18 toward the second end portion 22.

Alternatively, the net 18 can also be configured in a U-shaped cross sectional configuration such that the bottom of the U-shaped cross section faces generally toward a playing surface 26. In this manner the U-shaped net 18 surrounds the basketball on at least three sides, guiding the ball from the first end portion 20 generally toward the second end portion 22.

A frame 24 rests on a playing surface 26 and is preferably positioned immediately between the shooter and the backboard 14 and rim 16 combination. The net second end portion 22 is connected to the frame 24 by a plurality of cables 27. Preferably, four of such cables 27 are connected equidistantly spaced about the circumference of the net first end portion and to the frame 24 at four displaced locations. The cables 24 can be formed from rope, string, metal, etc.

The frame 24 acts to anchor the elongate net 18 at a preselected location, such that a basketball returning along the interior of the elongate net 18 arrives at the shooter's location. Further the frame 24 also includes a deflection board 28, which is positioned immediately adjacent the second end portion opening 22 of the elongate net 18. The deflection board 28 is positioned at a preselected angle relative to the playing surface 26. This preselected angle is preferably approximately 45 degrees, thus allowing the deflection board to deflect the returning basketball in a direction generally upward and toward the player standing immediately behind the frame 24.

The frame 24 includes two generally triangular sections 29, 29*a* joined together to form a roughly prismatic configuration. The triangular section 29*a* is hidden from view in the side view of FIG. 1, but is generally identical to the triangular section 29. One of the legs of each of the triangular sections rests upon the playing surface 26 providing frictional contact between the playing surface 26 and the frame 24. In particular, bridging handle elements 25, 25*a* form a rearward section of the triangular sections 29, 29*a*. These bridging handle elements 25, 25*a* are in contact with the playing surface 26. The combined weight of the frame 24 and frictional coefficient of the playing surface 26 prevents undesirable movement of the frame 24. However, portability is provided by a pair of wheels 30, 30*a* affixed to the forward apex of each triangular section 29, 29*a*. Preferably, an axle 31 passes through the forward apex of each of the triangular sections 29 and 29*a*, and is connected at each end to the wheels 30, 30*a*. Thus, the frame 24 is transported in a wheelbarrow manner by lifting the rear sections of the frame 24 and rolling the apparatus to its newly desired location.

Frame 24 can be constructed of a variety of materials, such as PVC, metal, wood, plastic, etc.

The deflection board 28 is connected to both of the triangular sections 29, 29*a*. The deflection board 28 is preferably constructed of plywood, however, other materials such as metal, plastic, wood, etc. can readily be substituted therefore. The deflection board 28 is pivotally connected to the frame 24, allowing the angle of the deflection board 28 to be adjusted to one of a plurality of preselected angles.

Figure 2:
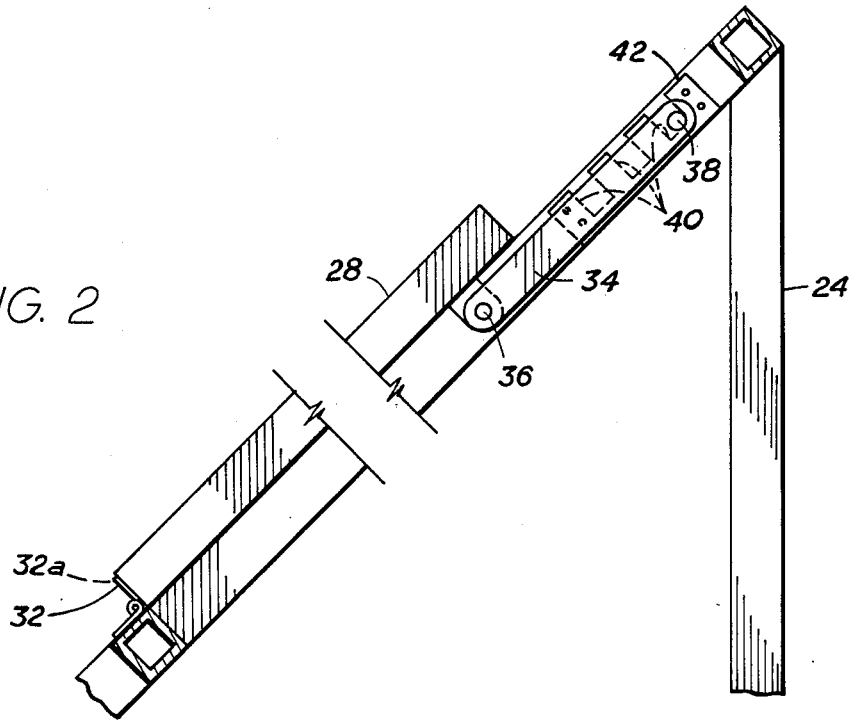
FIG. 2 is a side view of the frame, deflection board, and means for adjusting the angle of the deflection board.

Referring now to FIG. 2, the means for adjusting for the angular displacement of the deflection board 28 is illustrated in greater detail. A pair of hinges 32, 32*a* are connected to a first end portion of the deflection board 28 whereby the deflection board 28 is free to rotate about the center pin of the hinges 32, 32*a* in a range of approximately 30 degrees to 60 degrees.

Adjacent the second end portion of the deflection board 28, arms 34, 34*a* are pivotally connected thereto. The arms 34, 34*a* have a first and second end portion, whereas the first end portion is pivotally connected to the deflection board 28 via bolt 36 and the second end portion includes a rod extending at a right angle thereto. The rod 38 is adapted to engage a plurality slots 40 formed in a bracket 42. The bracket 42 is connected to each side of the triangular section 29. Accordingly it can be seen that by changing the angle of the arm 34 such that the rod 38 engages different ones of the slots 40, the deflection board 28 is caused to rotate about the center pin of the hinges 32, 32*a* thereby adjusting the angle of the deflection board 28.

It should be noted that the angle of the deflection board 28 is adjustable to account for varying speeds of the returning basketball. For example, when the frame 24 is position near the basket, the basketball traverses the same vertical height, but a shorter horizontal distance. Therefore, the approach angle is relatively steep and the speed of the ball is much greater. Thus, the deflection board 28 should be adjusted to increase the angle causing the ball to deflect at a greater vertical height while reducing the horizontal component of the deflected basketball. Conversely when the frame 24 is positioned at a greater distance from the basket, the approach angle of the basketball is less steep and the speed of the ball is slower, therefore, the angle of the deflection board 28 should be reduced to decrease the vertical component of the deflected basketball and maintain substantially the same horizontal component to the deflected ball. In this manner, the deflection speed and position of the basketball can be controlled to suit that desired by the shooter.

Other aspects, objects, and advantages of this invention can be obtained from the study of the drawings, the disclosure, and the appended claims.

What I claim:

1. An apparatus for use in combination with a basketball rim for returning a basketball passing through the rim to a preselected location on a playing surface, said apparatus comprising:

a portable deflection means positioned on said playing surface for deflecting the basketball to the preselected location on the playing surface; and transport means connectable to the rim and to said deflection means for transporting the basketball from the rim to impact against said deflection means, said deflection means being positionable and selectively orientable in position to change the preselected location on the playing surface; and said transport means, when connected to said rim and deflection means, operating such that a basketball passing through the rim enters said transport means, travels through said transport means, and exits said transport means in a direction toward said deflection means, the basketball deflecting off of said deflection means to the preselected location.

2. An apparatus as set forth in claim 1 wherein said transport means has a first end and a second end, and connecting means for connecting said second end in spaced relationship to said deflection means to create a space between said second end and said deflection means sufficient to permit a basketball to exit said second end, strike said deflection means and be deflected away from said deflection means to said preselected location, said first end being disposed below said rim.

3. An apparatus as set forth in claim 2 wherein a basketball net is connected to said rim, said first end of said transport means being connectable to the rim by means of the basketball net.

4. An apparatus as set forth in claim 2 wherein said deflection means includes a frame, said frame being movably positionable on the playing surface, and a deflection surface being connected to said frame at a preselected angle relative to the playing surface.

5. An apparatus as set forth in claim 4 wherein said second end of said transport means is connected to said deflection means to direct a basketball against said deflection surface.

6. An apparatus as set forth in claim 4 wherein said deflection surface is mounted for movement relative to said frame, said frame including adjustment of said deflection surface.

7. An apparatus as set forth in claim 6 wherein said adjustment means operates to adjust said deflection surface to a preselected angle within a range of between 30° and 60° to said playing surface.

8. An apparatus as set forth in claim 4 wherein said preselected angle is substantially 45° to said playing surface.

9. An apparatus as set forth in claim 4 wherein said frame includes wheel means for facilitating the positioning of said frame on said playing surface.

10. An apparatus as set forth in claim 9 wherein said frame further includes a support surface having at least portions which are engageable with the playing surface, said support surface having a first end frictionally engageable with the playing surface and a second end spaced from said first end, said wheel means being mounted on said second end to support said second end above the playing surface.

11. An apparatus as set forth in claim 10 wherein said frame is substantially triangular in configuration having a top apex spaced above said support surface, a first apex at said first end and a second apex at said second end, said wheel means being connected to said frame in the area of said second apex.

12. An apparatus as set forth in claim 10 wherein said first end of said support surface includes handle means to facilitate positioning said frame, said handle means operating with said wheel means when in engagement with said playing surface to position the remainder of said support surface in substantially spaced, parallel relationship to said playing surface.

13. An apparatus as set forth in claim 2 wherein said transport means comprises an elongate substantially closed-sided cylindrical-shaped tubular member having annular openings at said first and second ends, whereby the basketball enters said elongate tubular member through said first end annular opening, passes through said elongate tubular member, and exits through said second end annular opening.

14. An apparatus as set forth in claim 13 wherein said elongate substantially closed-sided cylindrical-shaped tubular member comprises a closed-sided cylindrical-shaped net.

15. An apparatus as set forth in claim 14 wherein a basketball net having an exit opening spaced below said rim is connected to said rim, and attaching means are provided to removably connect said first end of said elongate closed-sided cylindrical-shaped tubular member to the basketball net with the first end annular opening thereof positioned to receive a basketball passing through the exit opening of said basketball net.

* * * * *